United States Patent [19]

Dittrich et al.

[11] 4,071,637

[45] Jan. 31, 1978

[54] PROCESS FOR PUNCHING HOLES AND SLOTS IN STRUCTURAL TIMBER

[75] Inventors: Wolfhart Dittrich; Helmut Heuer; W. F. G. Kamm; Thorwald Kipp; Gerhard Lühr; Erich Poggemeier, all of Bad Oeynhausen, Germany

[73] Assignee: Eisenwerk Weserhutte AG, Germany

[21] Appl. No.: 754,930

[22] Filed: Dec. 28, 1976

Related U.S. Application Data

[62] Division of Ser. No. 666,576, March 15, 1976, abandoned.

[51] Int. Cl.[2] ..... B05D 3/02; B05D 1/18

[52] U.S. Cl. ..... 427/12; 34/13.4; 219/121 L; 219/121 LM; 219/121 EB; 219/121 EM; 219/383; 219/384; 427/317; 427/325; 427/440

[58] Field of Search ..... 34/13.4; 219/121 L, 219/121 LM, 121 EB, 121 EM, 383, 384; 427/12, 317, 325, 440

[56] References Cited

U.S. PATENT DOCUMENTS 2,631,109 3/1953 Gard ..... 427/325 X

*Primary Examiner*—Michael R. Lusignan
*Attorney, Agent, or Firm*—James E. Bryan

[57] ABSTRACT

This invention relates to a process for introducing holes or straight or circular slots approximately normal to the surface in the vicinity of the surface of round timber and to an approximately predetermined depth for the purpose of facilitating the penetration of impregnating means into the surface zones of the timber to better protect against chemical and biological attacks.

1 Claim, No Drawings

PROCESS FOR PUNCHING HOLES AND SLOTS IN STRUCTURAL TIMBER

This is a division of application Ser. No. 666,576, filed Mar. 15, 1976, now abandoned.

This invention relates to a process for introducing holes or straight or circular slots approximately normal to the surface in the vicinity of the surface of round timber and to an approximately predetermined depth for the purpose of facilitating the penetration of impregnating means into the surface zones of the timber to better protect against chemical and biological attacks.

Structural timber and the like must be protected against rot, microbe infestation and the like, i.e., against chemical and biological attack.

Various protective agents are known for this purpose, in particular impregnating means. When applying suitable impregnating means, it will be sufficient, as a rule, that the impregnating means penetrate the wood from 1 to 2 cm depending on the kind of wood in the surface zones to achieve adequate protection. Such a depth of penetration may be achieved in the direction of the grain in most woods for structural use. As a rule however, the required depth of impregnation in the conventional impregnation processes — even when the impregnating means are applied under pressure, and even when the water previously contained in the wood has been removed by subjection to a partial vacuum, or even when the timber or the surface zones thereof has or have been dried in other ways prior to impregnation — transverse to the grain cannot be achieved or will be inadequate, so that timber that has been impregnated even for relatively long periods will not be properly protected.

In order to enhance the depth of penetration of the impregnating means, approximately 2 cm deep holes are bored in round timber, for instance telgraph poles and the like, especially in the region which will be buried in the ground, and at suitable separations, in the radial direction, whereby the impregnating means will penetrate more deeply and a closed surface zone with sufficient protection against chemical and biologial attack is obtained.

It is further known how to increase the depth of penetration of the impregnating means for railroad ties and the like by punching short longitudinal slots therein, the so-called "incision process".

It was found however that for various timber or timber types, especially for cut timber, such incisions or holes must be relatively close to each other so that the surface zones will be impregnated deeply enough and completely. However, a concentrated array of holes made for instance by boring or in other mechanical ways is a laborious process and not economically feasible, and on account of the knots alone prsents technical difficulties. Again the loss in strength of the timber for high hole concentration must be considered. The same considerations apply to round or lengthwise slots if such are to be mechanically made.

The invention addresses the problem of economically introducing holes or straight or circular slots into the surface zones of round or cut timber so as to allow complete impregnation to a sufficient depth of the surface zone when using conventional impegnating methods.

The invention solves this problem in that the desired hole diameter or slot width is achieved by focusing radiation or jets of high energy or high energy density onto the material to destroy the same where the holes or slots are desired.

High energy beams as may be used for incising the timber are, for example, laser beams, electron rays, arc erosion or flash discharge.

Another possibility is to apply a strongly concentrated, continuous or pulsating liquid jet of high kinetic energy to the material for destroying th same at selected locations. This latter process is particularly advantageous if the liquid is composed of the impregnating means.

The beams or jets of high energy or energy density lending themselves to focusing or concentration, holes and slots of small diameters or narrow slot widths may be made, whereby the holes or slots may be relatively concentrated without the timber strength being degraded excessively, the concentration allowing complete impregnation of the surface zones of the timbers which thereby will be adequately protected against chemical and biological attack.

The introduction of the holes or slots into the surface zones of the timbers occurring at high rates, the process described above also is economical as compared to mechanical methods.

It will be obvious to those skilled in the art that many modifications may be made within the scope of the present invention without departing from the spirit thereof, and the invention includes all such modifications.

What is claimed is:

1. A process for introducing holes or straight or circular slots approximately normal to the surface of a cut timber to an approximately predetermined depth, comprising directing at least one arc erosion beam of high energy or high energy density at the sites of said holes or slots to destroy the timber material at said sites corresponding to the desired hole diameters or slot widths.

* * * * *